US008814609B2

(12) United States Patent
Hausner et al.

(10) Patent No.: US 8,814,609 B2
(45) Date of Patent: Aug. 26, 2014

(54) ADAPTER FOR A CLAMPING DEVICE

(75) Inventors: Oliver Hausner, Amberg (DE); Christian Metschl, Ensdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/599,623

(22) Filed: Aug. 30, 2012

(65) Prior Publication Data

US 2013/0052885 A1 Feb. 28, 2013

(30) Foreign Application Priority Data

Aug. 31, 2011 (DE) ..... 10 2011 081 855

(51) Int. Cl.
*H01R 4/48* (2006.01)

(52) U.S. Cl.
USPC ..... 439/834; 439/810

(58) Field of Classification Search
USPC ..... 439/779–863
See application file for complete search history.

(56) References Cited

U.S. PATENT DOCUMENTS

| | | | | |
|---|---|---|---|---|
| 2,132,967 | A * | 10/1938 | Pennell | 439/793 |
| 2,262,372 | A * | 11/1941 | Rogoff | 439/780 |
| 2,976,515 | A * | 3/1961 | Charbonneau et al. | 439/811 |
| 3,124,409 | A | 3/1964 | Nisula | |
| 3,125,398 | A * | 3/1964 | Wolf | 439/812 |
| 3,683,414 | A * | 8/1972 | DeAngelo et al. | 439/737 |
| 3,836,941 | A * | 9/1974 | Izraeli | 439/810 |
| 4,103,986 | A * | 8/1978 | Izraeli | 439/811 |
| 4,986,761 | A * | 1/1991 | Gladden et al. | 439/99 |
| 5,032,092 | A * | 7/1991 | Linn | 439/723 |
| 5,553,787 | A * | 9/1996 | Guginsky | 439/812 |
| 6,231,405 | B1 * | 5/2001 | Diconne et al. | 439/812 |
| 7,364,476 | B2 * | 4/2008 | Mueller | 439/709 |
| 7,404,745 | B1 * | 7/2008 | Wu | 439/811 |
| 7,575,486 | B2 * | 8/2009 | Weber et al. | 439/811 |

FOREIGN PATENT DOCUMENTS

| | | | |
|---|---|---|---|
| AT | 341600 | B | 2/1978 |
| DE | 8915575 | U1 | 11/1990 |
| DE | 19929840 | A1 | 1/2000 |
| FR | 2925983 | B1 | 1/2010 |

* cited by examiner

*Primary Examiner* — Briggitte R Hammond
(74) *Attorney, Agent, or Firm* — Harness, Dickey & Pierce, P.L.C.

(57) ABSTRACT

An adapter for a clamping device for the electrical connection of a cable or line is disclosed. The clamping device includes an electrical contact point and a height-adjustable clamping plate, and the clamping plate is designed to press the cable or line mechanically against the electrical contact point of the clamping device. In at least one embodiment, the adapter is designed to be able to be fastened to the clamping plate of the clamping device, so that using the adapter it is possible to carry out an adaptation to the cross-section of the cable or line to be clamped, to carry out an adaptation to the elevation of the height-adjustable clamping plate of the clamping device or to adjust the width of the clamping plate.

19 Claims, 4 Drawing Sheets

ADAPTER FOR A CLAMPING DEVICE

PRIORITY STATEMENT

The present application hereby claims priority under 35 U.S.C. §119 to German patent application number DE 102011081855.3 filed Aug. 31, 2011, the entire contents of which are hereby incorporated herein by reference.

FIELD

The present invention generally relates to an adapter for a clamping device.

BACKGROUND

Clamps used for the detachable attachment or connection of cables, wires or lines to one another or to devices are generally known in electrical engineering. The clamping devices ensure a long-term and secure electrical contact. The electrical contact is achieved by mechanically fixing the attached cables, wires or lines in an electrically conductive body using a screw or spring. Clamping devices can likewise be attached to electrical devices, so that these electrical devices can be electrically contacted using cables or lines.

For example, housings of circuit-breakers, which typically can switch currents from 10 A to 100 A and more, include such clamping devices. Individual phases of the currents are typically switched separately, for example in what is known as a pole housing. Accommodated in the pole housing are a movable contact and a fixed contact, which can be mechanically opened or closed to switch the current off or on respectively. Electrical switches can be designed to switch an individual phase, or else several phases. The individual phases of the currents are managed by means of cables or lines to the housing of the circuit-breaker and are connected there by way of clamping devices.

FIG. 1 shows a clamp 100 typical of the type used. The clamp comprises a base body 110, which is for example bent such that it comprises an opening for receiving a cable or line. According to FIG. 1 the opening has a height T and a width W, and extends along the length L. In FIG. 1 a cable or line with a circular cross-section of circumference U is schematically drawn in, and projects into the opening of the base body 110. A clamping plate 200, which is designed to be height-adjustable, can be moved downward according to the illustration in FIG. 1 and thus presses the cable or line against an electrical contact point 300 of the clamping device 100. The electrical contact point 300 of the clamping device 100 can for example be the terminal lug of a fixed contact of the electrical switch.

Typical clamping devices have the disadvantage that they cannot optimally accommodate cables or lines of different cross-sections and thus do not have a large dynamic range. Typically the clamping plate 200 is designed to be curved on the side facing the cable and this curvature is adjusted to the surface curvature of the cable. Likewise the middle of the clamping plate 200 can be designed to be straight on the side facing the cable with surfaces drawn downward in the edge region of the clamping plate 200 to enclose the cable. If for example a cable with a much smaller cross-section is now to be clamped in such a clamping device there is a risk that the cable cannot be fixed by the height-adjustable clamping plate and slips out of the clamping connection. For this reason different clamping devices have until now been built into circuit-breakers for cables with very different cross-sections.

SUMMARY

An adapter for a clamping device is provided which enables cables or lines with different cross-section surfaces to be attached using just one clamping device.

The adapter of at least one embodiment, for a clamping device for the electrical connection of a cable or line, wherein the clamping device comprises an electrical contact point and a height-adjustable clamping plate, wherein the clamping plate is designed to press the cable or line mechanically against the electrical contact point of the clamping device, is to this end designed so that it can be fastened to the clamping plate of the clamping device. As such, using the adapter is possible to carry out an adaptation to the cross-section of the cable or line to be clamped, to carry out an adaptation to the elevation of the height-adjustable clamping plate of the clamping device or to adjust the width of the clamping plate.

BRIEF DESCRIPTION OF THE DRAWINGS

Further advantages and embodiments of the invention are explained below with the aid of example embodiments and with the aid of the drawing, in which.

Figure 1:
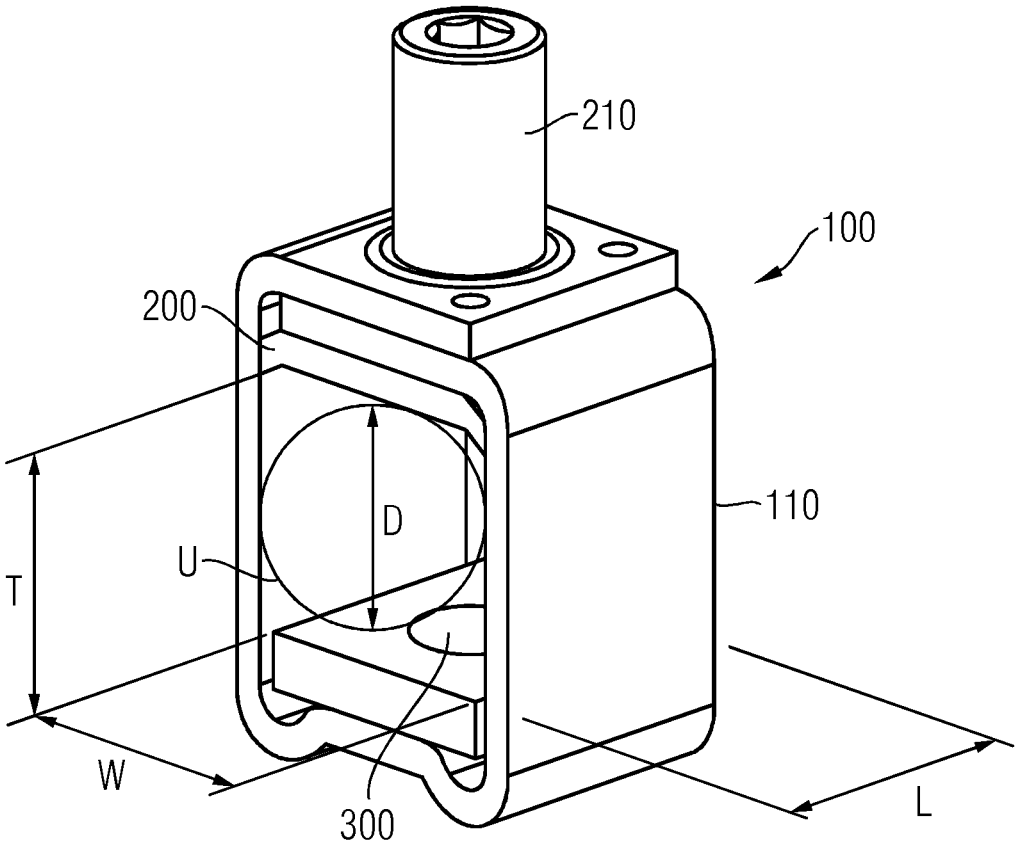
FIG. 1 illustrates clamping device for the electrical connection of a cable or line with an electrical contact point and height-adjustable clamping plate.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The adapter of at least one embodiment, for a clamping device for the electrical connection of a cable or line, wherein the clamping device comprises an electrical contact point and a height-adjustable clamping plate, wherein the clamping plate is designed to press the cable or line mechanically against the electrical contact point of the clamping device, is to this end designed so that it can be fastened to the clamping plate of the clamping device. As such, using the adapter is possible to carry out an adaptation to the cross-section of the cable or line to be clamped, to carry out an adaptation to the elevation of the height-adjustable clamping plate of the clamping device or to adjust the width of the clamping plate.

It is advantageous here that when installing cables or lines with different cross-sections, the clamping device itself does not have to be replaced on the device, but a standardized clamping device can be adjusted by way of the inventive adapter of at least one embodiment. It is further advantageous that by way of the adapter, it is possible to adjust the curvature of the clamping plate, to carry out an adaptation to the elevation of the height-adjustable clamping plate of the clamping device or to adjust the width of the clamping plate.

In one embodiment of the invention, the adapter additionally comprises at least one fastening device, which is designed to interwork with the clamping plate to fasten the adapter to the clamping plate.

It is advantageous here that, thanks to the fastening device, the adapter can easily be replaced. This allows the installer, when installing a cable or line, to easily individually adjust the clamping device to the cable or line.

In another embodiment of the invention the at least one fastening device is designed as a resilient element. The at least one resilient element can be designed as a clip.

In another embodiment of the invention the adapter can be fastened to the side of the clamping plate facing the cable or line.

In another embodiment of the invention the adapter additionally comprises at least one first lamella on the side of the clamping plate facing the cable or line. It is advantageous here that the first lamella of the adapter interworks with the clamping plate of the clamping device and thereby permits a stable and slip-free connection of adapter and clamping plate.

In another embodiment the adapter additionally comprises at least one second lamella on its side facing the cable or line. It is advantageous here that the cable or line is held secure in the clamping device by this second lamella under mechanical stress.

In another embodiment of the invention the adapter is part of a clamping device which comprises an electrical contact point and a height-adjustable clamping plate, wherein the adapter is attached to the side of the clamping plate facing the cable or line.

FIG. 1 shows a clamping device 100 for the electrical connection of a cable or line. The frame of the clamping device 100 is formed by a base body 110, which typically is formed from a bent strip of C30 or C45 steel, stainless steel or brass. The base body 110 has an opening of height T and width W, into which a cable or line can be inserted into the base body 110. The base body 110 has a depth L. In FIG. 1 the cable or line is indicated with a circular cross-section U of diameter D. The clamping device 110 further has a height-adjustable clamping plate 200 and a contact point 300. If a cable or line is inserted into the base body, the height-adjustable clamping plate 200 is moved out of the open position—according to the illustration in FIG. 1—to the contact point 300 by a screw motion of the height adjustment mechanism 210 connected thereto. This means that the clamping plate 200 presses the cable or line mechanically against the electrical contact point 300.

Figure 2A:
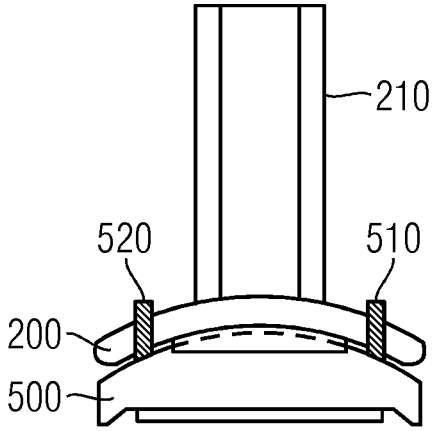
FIGS. 2A and 2B illustrate an adapter for a clamping device mounted on the clamping plate and adapter for a clamping device with fastening devices.

FIG. 2A likewise shows a height-adjustable clamping plate 200 and the height adjustment mechanism 210. The underside of the height-adjustable clamping plate 200 is for example provided with a curvature. The curvature of the clamping plate 200 is adjusted to the curvature of the cable or line to be clamped. In the case of a cable with a circular cross-section the curvature radius of the cable and the curvature radius of the underside of the clamping plate 200 should not be too different, since otherwise a secure mechanical connection by the clamping device 100 is not guaranteed.

FIG. 2A shows an adapter 500 in addition to the height-adjustable clamping plate 200 and the height adjustment mechanism 210. The adapter 500 is connected to the clamping plate 200 by the fastening devices 510, 520 and is held thereon. The adapter 500 is fastened to the clamping plate 200 of the clamping device 100, so that using the adapter 500 it is possible to carry out an adaptation to the cross-section of the cable or line to be clamped and/or to carry out an adaptation to the elevation of the height-adjustable clamping plate 200 of the clamping device 100. According to FIG. 2A the adapter 500 is fastened to the side of the clamping plate 200 facing the cable or line. In the illustration according to FIG. 2A the top of the adapter 500 is connected to the underside of the clamping plate 200. The curvature of the clamping plate 200 on the side facing the cable or line (underside of the clamping plate 200 in the illustration according to FIG. 2A) has the same curvature as the top of the adapter 500, and is thus designed negatively to the contour of the clamping plate 200 for an accurate fit of the adapter 500 on the clamping plate 200. The underside of the adapter 500 has a different curvature and is adjusted to the curvature of the cable or line.

Figure 2B:
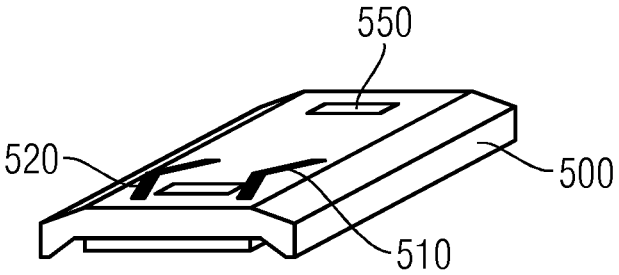

FIG. 2B shows the adapter 500 without the height-adjustable clamping plate 200. The fastening devices 510, 520 are designed as a resilient element. The fastening devices 510, 520 are designed such that the adapter 500 can be pushed from one side onto the clamping plate 200. Consequently the adapter 500 has fastening devices 510, 520 only on one side. In addition to the fastening devices 510, 520 the adapter 500 has a first lamella 550 which is attached to the side of the clamping plate facing the cable or line. The first lamella 550 thus exhibits a certain surface roughness compared to the underside of the height-adjustable clamping plate 200 and prevents the adapter 500 easily shearing off from the clamping plate 200. The underside of the height-adjustable clamping plate 200, in other words the side of the clamping plate 200 facing the cable or line, can likewise be provided with a lamella, which interworks with the first lamella 550 of the adapter 500 for an improved mechanical connection between clamping plate 200 and adapter 500. The clamping plate 200 is typically provided with lamellas, which improve the hold of the clamped cable or line. The lamella 550 can likewise be designed as a serration or knurling on the adapter 500.

The adapter 500 can be designed such that it adjusts the width of the clamping plate 200. In the illustration according to FIG. 2A this means that the adapter 500 projects laterally to the right and/or left over the clamping plate 200, the adapter 500 being wider than the clamping plate 200.

Figure 3A:
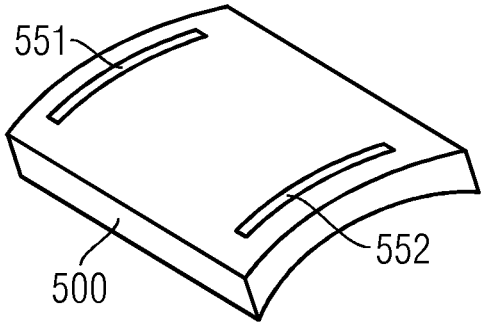
FIGS. 3A and 3B illustrate an adapter for a clamping device with first lamellas and adapter for a clamping device with second lamellas.
Figure 3B:
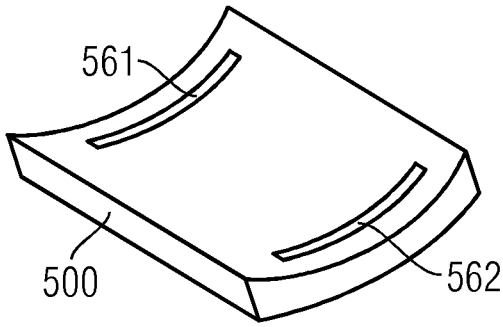

FIGS. 3A and 3B illustrate the adapter 500. FIG. 3A shows a top view of the adapter from the side facing the clamping plate 200. FIG. 3B shows a top view of the adapter 500 from the side facing the cable or line (opposite side to the illustration in FIG. 3A). FIG. 3A likewise illustrates the adapter 500 with first lamellas 551, 552. These first lamellas 551, 552 stop the adapter 500 shearing away from the height-adjustable clamping plate 200. The lower side of the adapter 500 facing the cable or line is provided with second lamellas 561, 562 according to FIG. 3B. These second lamellas 561, 562 interwork with the cable or line to be clamped and increase the stability of the connection from the adapter 500 to the cable or line. First lamellas 551, 552 or second lamellas 561, 562 can likewise be designed as a serration or knurling on the adapter 500.

The adapters 500 according to FIGS. 3A and 3B can be designed with different thicknesses. As a result the elevation of the height-adjustable clamping plate 200 can be adjusted. This enables cables or lines of different cross-sections to be electrically contacted using the same height adjustment mechanism 210 by clamping device 100 and adapter 500.

Figure 4A:
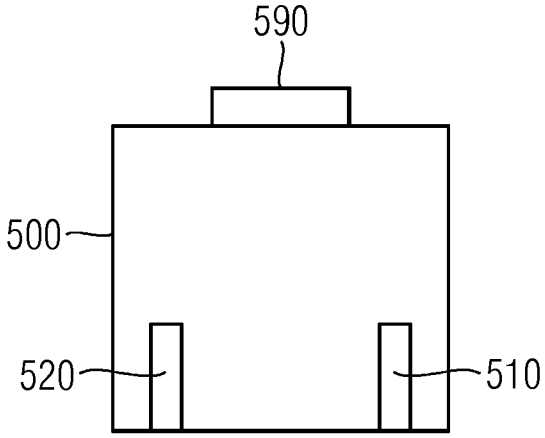
FIGS. 4A and 4B illustrate an adapter for a clamping device in a first and in a second perspective.
Figure 4B:
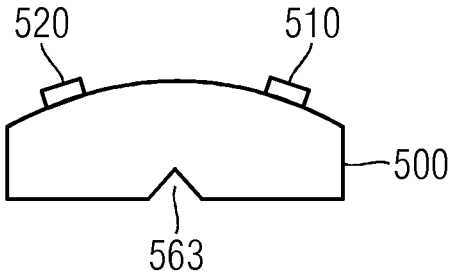

FIGS. 4A and 4B illustrate another example embodiment of an adapter 500 for a clamping device 100 in a first and a second perspective. The adapter 500 is connected by the fastening devices 510, 520 to the clamping plate 200 and is held thereon. The adapter 500 additionally comprises a snap-in hook 590, which is used to lock the adapter 500 on the clamping plate 200. The adapter 500 is pushed laterally onto the clamping plate 200 and is fixed by the snap-in hook 590 or similar fastening devices.

FIG. 4A illustrates a top view of the adapter 500 in a first perspective. FIG. 4B illustrates the adapter 500 from the side. The fastening devices 510, 520 are attached to the side of the adapter 500 facing the clamping plate 200 (top side in the illustration in FIG. 4B). The curvature of the top side of the adapter 500 is adjusted to the curvature of the clamping plate 200 on the side of the clamping plate facing the cable or line 200. The curvature or shape of the side of the adapter 500 facing the cable or line is adjusted to the shape and diameter of the cable or line to be clamped. The lower side of the adapter 500 facing the cable or line comprises a serration 563, by which the cable or line to be clamped is held fast.

The resilient elements as fastening devices 510, 520 according to FIGS. 2A and 2B can be designed as clips, so that the adapter 500 is clipped onto the height-adjustable clamping plate 200.

Using different adapters 500 the same clamping device 100 can be used for cables or lines of a wide variety of cross-section surfaces. Thus because of the adapter 500 it is possible to electrically contact cables with cross-sections of 1.5 $mm^2$ to 300 $mm^2$ in the same clamping device 100. For different cross-sections or value ranges of cross-sections different adapters 500 can be provided which have different curvatures on the side facing the cable or line and likewise have different thicknesses.

The additional adapter 500 makes it possible to dispense with redesigning the entire clamping device 100. The adapter 500 can be adjusted to the specific requirements of for example small cable or line cross-sections.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adapter for a clamping device for the electrical connection of a cable or line, the clamping device including an electrical contact point and a height-adjustable clamping plate and the clamping plate being designed to press the cable or line mechanically against the electrical contact point of the clamping device, the adapter being fastenable to the clamping plate of the clamping device, the adaptor comprising:

a body having a first surface facing the clamping plate and a second surface facing the electrical contact point; and at least one fastening device extending from the first surface.

2. The adapter of claim 1, wherein:

the at least one fastening device is fittable over an outer edge surface of the clamping plate to interwork with the clamping plate to fasten the adapter to the clamping plate.

3. The adapter of claim 1, wherein the at least one fastening device is a resilient element.

4. The adapter of claim 1, wherein the at least one fastening device is a clip.

5. The adapter of claim 1, wherein the adapter is designed to be able to be fastened to a side of the clamping plate facing the cable or line.

6. The adapter of claim 1, further comprising:

at least one first lamella on the second surface of the body facing the cable or line.

7. The adapter of claim 6, further comprising:

at least one second lamella on the second surface of the body facing the cable or line.

8. A clamping device, comprising:

an electrical contact point;

a height-adjustable clamping plate; and an adapter of claim 1, wherein the adapter is attachable to a side of the clamping plate facing the cable or line.

9. The adapter of claim 2, wherein the adapter is designed to be able to be fastened to a side of the clamping plate facing the cable or line.

10. The adapter of claim 3, wherein the adapter is designed to be able to be fastened to a side of the clamping plate facing the cable or line.

11. The adapter of claim 9, further comprising:

at least one first lamella on the second surface of the body facing the cable or line.

12. The adapter of claim 11, further comprising:

at least one second lamella on the second surface of the body facing the cable or line.

13. The adapter of claim 10, further comprising:

at least one first lamella on the second surface of the body facing the cable or line.

14. The adapter of claim 13, further comprising:

at least one second lamella on the second surface of the body facing the cable or line.

15. The clamping device of claim 8, wherein the adapter includes at least one fastening device, designed to be able to interwork with the clamping plate to fasten the adapter to the clamping plate.

16. The clamping device of claim 15, wherein the at least one fastening device is designed as at least one resilient element.

17. The clamping device of claim 16, wherein the at least one resilient element is designed as a clip.

18. The adapter of claim 1, further comprising at least one first lamella on the first surface of the body facing the clamping plate.

19. The adapter of claim 18, further comprising at least one second lamella on the first surface of the body facing the clamping plate.

* * * * *